United States Patent [19]

Schröter

[11] 4,050,362

[45] Sept. 27, 1977

[54] PROCESS AND APPARATUS FOR BLANKING CARDBOARD AND THE LIKE

[76] Inventor: Friedrich Schröter, 3004 Isernhagen, NB-Sud am Waldchen 8, Germany

[21] Appl. No.: 485,776

[22] Filed: July 5, 1974

[51] Int. Cl.[2] ..... B31B 1/20

[52] U.S. Cl. ..... 93/58 R; 83/53; 83/177; 93/58.4; 93/59 R

[58] Field of Search ..... 93/58.2 F, 58.2 R, 58 R, 93/58 ST, 58.1, 58.3, 58.4, 58.5, 59 R; 76/107 R, 107 C; 83/347, 53, 177, 402, 431

[56] References Cited

U.S. PATENT DOCUMENTS

| | | | |
|---|---|---|---|
| 124,669 | 3/1872 | Delkescamp | 83/53 X |
| 2,055,077 | 9/1936 | Guerin | 83/53 X |
| 2,351,475 | 6/1944 | Berger | 83/53 X |
| 2,810,329 | 10/1957 | Schmidt et al. | 93/58.2 R |
| 3,142,233 | 7/1964 | Downie | 93/58 R |
| 3,355,969 | 12/1967 | Sarka | 93/58.2 F X |
| 3,485,146 | 12/1969 | Sarka | 93/58 R |
| 3,618,438 | 11/1971 | Simson | 83/347 X |
| 3,678,577 | 7/1972 | Weglin et al. | 83/53 X |

*Primary Examiner*—James F. Coan
*Attorney, Agent, or Firm*—Warren, Chickering & Grunewald

[57] ABSTRACT

A process and apparatus for cutting, creasing and/or embossing sheets of cardboard, paper of similar material is disclosed. The apparatus includes a tool plate or die having steps therein in the form of parting steps and ribs and/or grooves to form creases. A resilient elastic member is employed to press the cardboard web down against the various steps in the tool plate. The size and configuration of the steps and the tool plate causes severing or cutting of the cardboard or creasing or embossing. Apparatus for use with rotational as well as planar or reciprocating blanking machines and a variety of different tool plate constructions are disclosed. The process includes resilient urging of the sheet against the die piece with the elastic member causing deformation of the sheet to conform to the tool plate.

3 Claims, 18 Drawing Figures

PROCESS AND APPARATUS FOR BLANKING CARDBOARD AND THE LIKE

BACKGROUND OF THE INVENTION

The present invention includes a method and apparatus for cutting creasing and/or embossing of stock in sheet or web form, of paper, cardboard or similar material by the combined action of two surfaces.

The method of the present invention is to be used preferably to make folding boxes or similar work pieces.

To date, such work pieces were blanked almost exclusively with flat strip steel punches. It has also been suggested that a scissor cut between two steel plates with etched surface patterns may be employed (U.S. Pat. No. 3,170,342 and German Pat. No. 1,611,626). Such steel plates have been further modified by recommending a crimping parting cut (German Pat. No. 1,940,830). Both suggestions also provide for the use of such tools for rotational blanking. Attempts have been made to utilize the fundamental advantages of rotational blanking by adapting punching knives formed of known construction (flat strip steel) to the curve of a punching cylinder. To facilitate this adaptation, especially for cutting lines which run at a slant over the cylinder or are curved, other shapes of the knives have been suggested (German Pat. No. 2,032,145 and others).

While the commonly used strip steel punch is inexpensive to make, the correct adjustment of the punch to compensate for unavoidable variations in the measurements of the knives and pressure at the cutting surfaces in automatic punching machines and elastic deformation are very time consuming. Even more time is wasted in the case of a cylindrical tool, since the adaptation of the punching knives to the curve of the cylinder brings additional defects which must be compensated for with additional fitting work.

This fitting work is not necessary if steel plates with etched surface patterns of flat or cylindrical form are used, but high precision in the location of the cutting lines is required when the combined action of pairs of punches is to be employed, creating yet further difficulties. In addition to the other disadvantages, the higher price of these tools speaks against their being widely used.

It is the purpose of this invention to provide a method for blanking stock in sheet or web form, of paper, cardboard or similar material, using a tool which is inexpensive to make and can be used flat or in cylindrical form without requiring adjustment of the cutting lines.

According to the present invention the problem has been solved by providing a first surface at the parting lines of the stock with rigid steps, while a second surface is made of softer, preferably elastic material, whereby each of said surfaces may be flat or cylindrical.

As soon as a sufficient force presses both surfaces towards each other, the stock in between is divided at the steps, whereupon the elastic of the two surfaces assumes the shape of the stepped surface.

If both surfaces are flat, the entire form is parted.

If one surface is cylindrical, the action of the force is limited to a narrow zone which progresses with the revolution of the cylinder and the roller movement between the cylinder and flat surface over the length of the sheet.

If both surfaces are cylindrical, the action of the force is limited to a narrow zone which progresses with the revolution of boty cylinders over the length of the sheet, such revolution also conveying the stock between the cylinders.

One important embodiment of said invention includes negative or positive creasing elements in the form of grooves or ribs arranged in the first plate. This produces creases in a single operation with the parting or cutting of the work pieces, whereby the stock is formed by pressing the elastic surface into the groove or around the ribs.

A further supplement to this embodiment of said invention consists in equipping the first plate with negative or positive coining dies. This makes it possible in a single operation, to not only blank and crease, but also coin the work pieces, since the elastic surface presses the stock into the coining die.

Another embodiment of the invention calls for the die steps to be made by tooling or machining of a plate, which plate can be used with a flat, curved or cylindrical blanking apparatus.

Still another embodiment of the invention calls for the die steps to be made by mounting elements on a plate, which plate can be used with a flat, curved or cylindrical blanking apparatus.

A further embodiment of said invention calls for the die steps to be formed by tooling or machining of a cylinder.

In a fourth embodiment of said invention the steps are formed by mounting elements on a cylinder.

The first two embodiments are particularly inexpensive in their manufacture, so that they are recommended for use with a large number of frequently changed patterns. The latter two embodiments are recommended mainly for mass production of one pattern over a long period of time. It is also possible to combine the formation of the die steps by tooling and by mounting of elements in one and the same tool.

For certain applications it is advisable to form the die steps at varying distances from the base of the flat plate or center of the cylinder. This arrangement makes it possible to blank areas of the stock in which more than two different parts touch, e.g., two work pieces and one waste piece.

It is advantageous that elastic waste ejector elements are arranged on the lower areas of the plate or cylinder. It is also possible to feed compressed air to the lower areas of the plate or cylinder. Each of the two last-mentioned measures will result in raising of the material parts which were pressed by the blanking process into the recesses formed by the steps, as soon as the two die surfaces part after the blanking process.

It is advantageous to coat the elastic surface with a material of low friction value. The stretching caused by deformation of the elastic surface results in local displacements or relative movement between the surface of the stock and the elastic surface. By lowering the friction value, the thus created friction stress is lowered.

The elastic surface can be limited in shape or effect to the areas of stock to be worked. This will reduce the force needed to compress the two areas, since the force required for blanking per surface unit need be provided for only a small area.

The invention provides the following advantages: The precision with which the die set is to be made, is determined only by the requirements of work pieces to be made. The process itself does not require any special precision, either as to flatness or as to cylindrical form, nor for the position of the cutting lines with respect to each other. The combined action of pairs of tool elements is eliminated. This also applies to the creasing lines which consist of negative and positive elements in the commonly used strip steel punch. In that case they must be adjusted with precision, otherwise unilateral or slanted creases will result, which disturb the further forming of the box forms in the pasting and packing machines.

It is no longer necessary to adjust the cutting lines, and this results first of all in a considerable time saving during each change of pattern. Additionally, there is not time-consuming checking and supplementing of the punch adjustment during blanking.

These advantages make the process of the present invention superior in its use over common automatic punching machines with flat tools. Even greater economic savings are attained if the process is used with rotating punching machines which permit much higher stock speeds. These machines are also more economical in their production than the punching machines with flat tools, so that the invention will result in a considerable lowering of manufacturing costs for folding boxes and similar work pieces.

DESCRIPTION OF THE PREFERRED EMBODIMENTS

Figure 1:
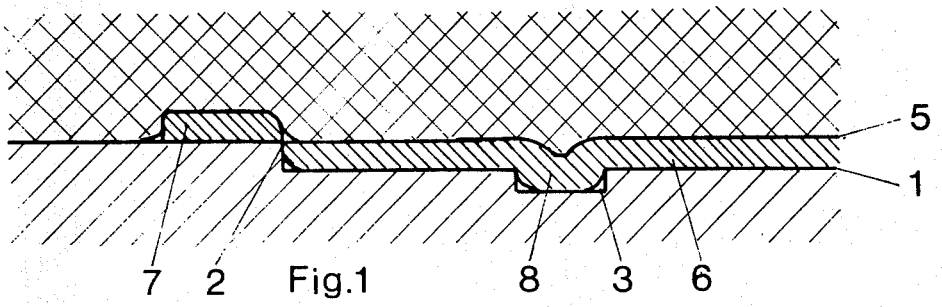
FIGS. 1 through 4 are side elevational view, in cross-section, of four forms of tool plates constructed in accordance with the present invention and suitable for use in the process of the present invention.

In FIGS. 8 to 11 and 13 to 15 the material thickness and the thickness of the tool plate were shown superelevated for sake of clarity.

In FIGS. 1 to 4 numeral 1 indicates the tool areas which are equipped along the parting lines of the stock with rigid steps 2. Where creasing lines are required in the work piece, the areas 1 are equipped with grooves 3 or ribs 4. The elastic area 5 is pressed onto the stock, which is disposed between areas 1 and 5, and the stock is thereby parted at the steps 2 into the work piece 6 and the marginal waste 7. At the same time, negative creasing lines 8 are formed at grooves 3 or positive creasing lines 9 at ribs 4 by deformation of the stock under the force of the elastic area 5.

Figure 2:
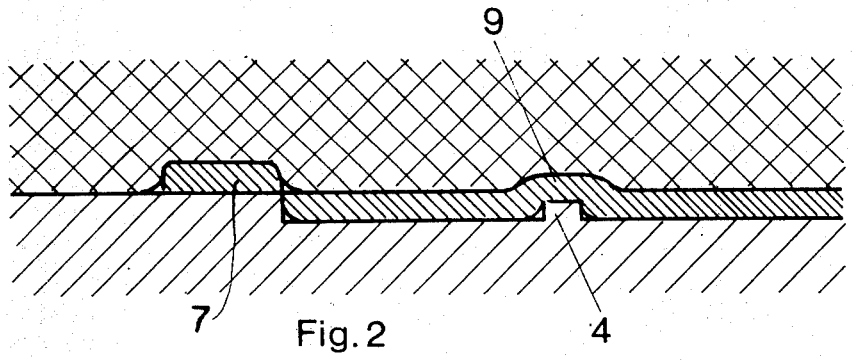

FIGS. 1 and 2 show embodiments of the invention in which the marginal waste 7 remains in the plane in which the stock was prior to blanking, while the work piece 6 is being pressed by blanking into the recessed area surrounded by steps 2. FIGS. 1 and 2 differ in the arrangement of negative or positive creasing elements 3 and 4.

Figure 3:
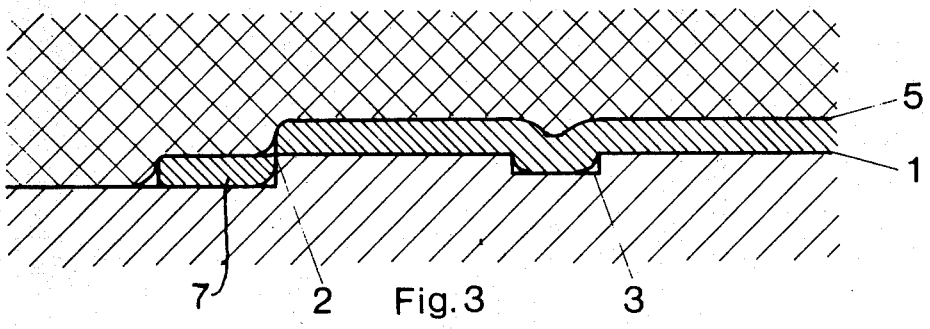

In FIG. 3, the work piece 6 remains in the plane in which the stock was prior to blanking, while the marginal waste 7 is being pressed by blanking to the recessed area, limited inwardly by step 2 surrounding the work piece 6.

Figure 4:
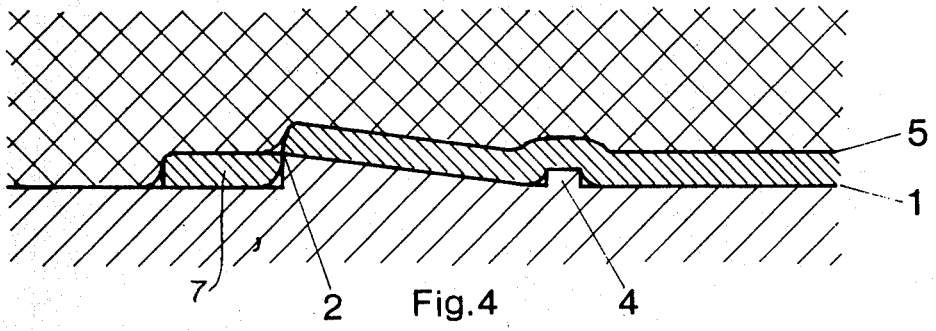

According to FIG. 4, step 2 can be made tapered, so that the work piece 6 as well as the marginal waste 7 can be pressed into one plane, while only the edges of the work piece 6 rise towards the level of step 2.

The various embodiments of the parting steps and creasing elements shown in FIGS. 1 to 4 can also be combined in one and the same tool. Negative or positive embossing elements are formed the same way as the creasing elements.

Figure 5:
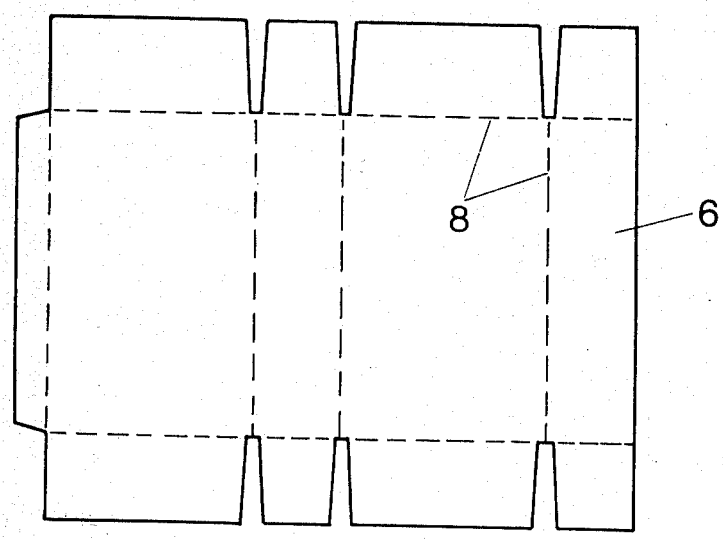
FIG. 5 is a top plan view of a work piece (folding box) made with the process and apparatus of the present invention.
Figure 6:
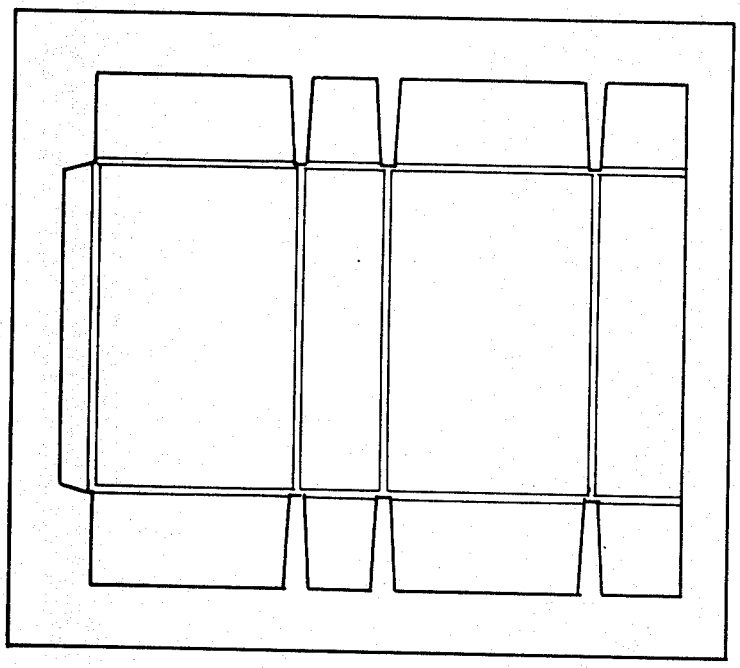
FIG. 6 is a top plan view of a tool plate and punch for making the work piece of FIG. 5.
Figure 7:
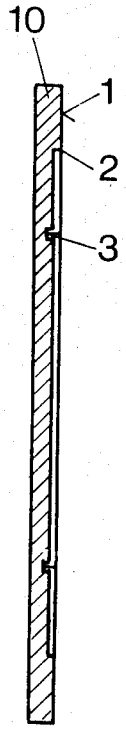
FIG. 7 is an end elevational view, in cross-section, of the tool plate and punch of FIG. 6.

FIG. 5 shows a work piece (folding box) to be blanked and creased according to the invention. FIGS. 6 and 7 show a tool plate 10 for making the work piece, in top view and in section. In the working plane 1, the shape of the work piece 6 is formed as step 2, the creasing lines 8 of work piece 6 are tooled or formed as grooves 3 in plate 10.

The tool plate 10 is an example of an embodiment including steps 2 and creasing elements 3 according to FIG. 1. In a manner similar to the plates of FIGS. 1 to 4, the steps and creasing elements of tool plate 10 were made by special tooling and this can be done in a flat as well as a cylindrically formed surface 1. FIGS. 1 to 4 must be understood not only as sections through flat tool plates, but also a longitudinal sections through tool cylinders.

FIGS. 8 to 15 illustrate some device for making the work piece 6 according to FIG. 5, in which the working surface 1 is formed by mounting elements on a plate or cylinder. As already stated, the thickness of the stock and tool plates is shown superelevated in these drawings for the sake of clarity.

Figure 8:
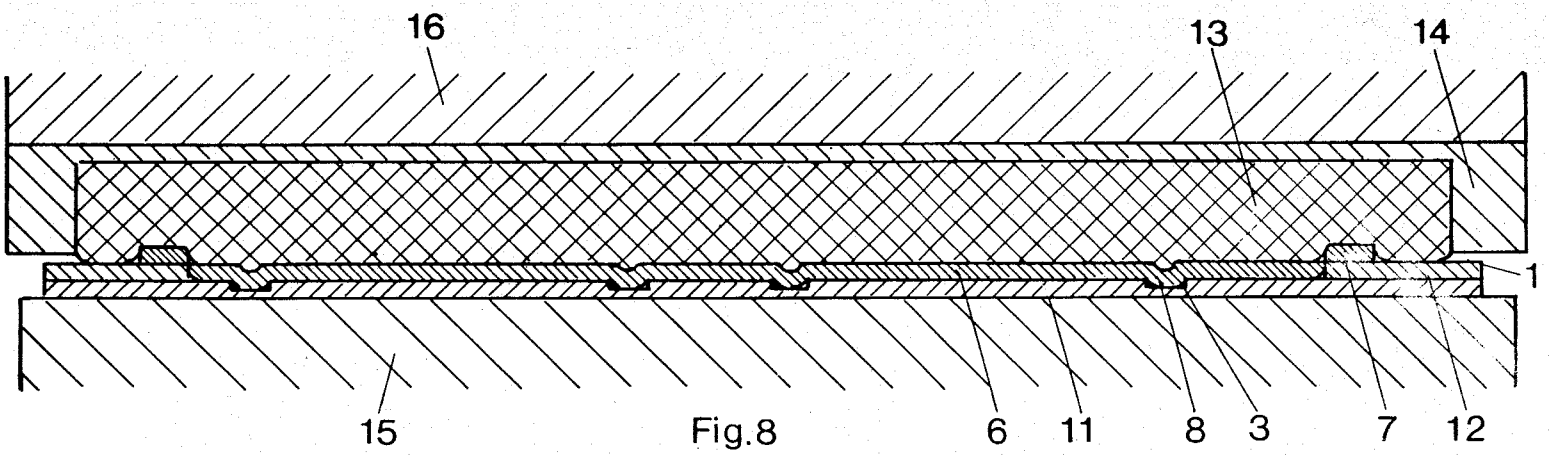
FIGS. 8 through 11 are side views, in cross-section, of additional devices for making the work piece of FIG. 5, with said devices shown in a working position.

FIG. 8 is the longitudinal section of a device which blanks the stock according to the principle shown in FIG. 1. On a base plate 11, formed with grooves 3 to form crease lines 8, a frame 12 is mounted whose inner contour or periphery corresponds to the shape of the work piece 6. Frame 12 can be made up of several parts and is fixed to the base plate 11, e.g., by glueing or spot welding. The elastic surface has been provided by the surface of elastic pressure pad 13 which is held in a frame 14. The lower work table is 15, and the top table of a blanking machine with flat work surfaces is 16.

Figure 9:
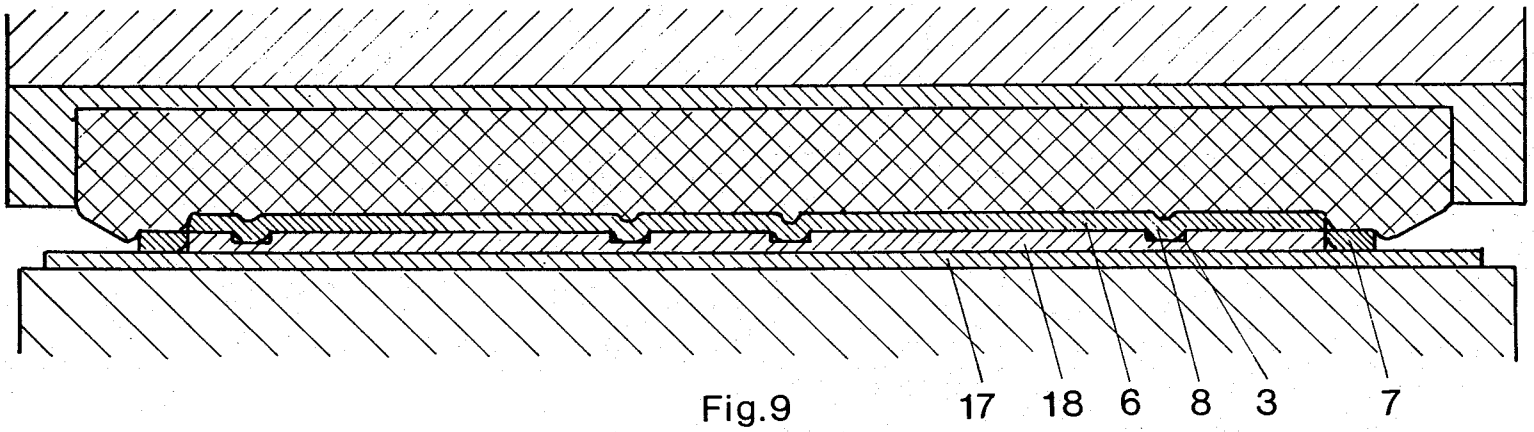

In FIG. 9 we show blanking or parting according to the principle shown in FIG. 2. For this purpose, plate 18, with the shape of the work piece 6, is mounted on a base plate 17, and plate 18 is formed with grooves 3 to form the crease lines 8. The remaining structure is the same as in FIG. 8.

Figure 10:
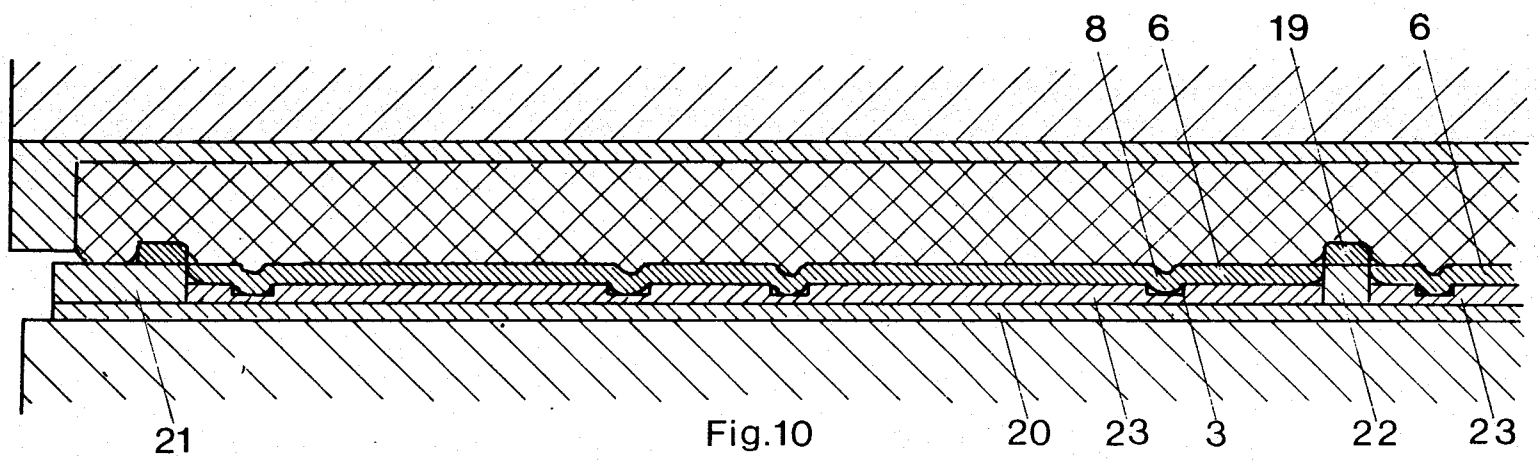

In FIG. 10, blanking takes place according to the same principle as in FIG. 8, but several work pieces 6, separated by waste web 19, are blanked and creased simultaneously. On a base plate 20, several frames are formed to provide the inner contour of which corresponds to the shape of work piece 6. For this purpose, in addition to the external frame parts 21, bridges 22 have also been mounted on the base plate 20. Plates 23 having the shape of the work pieces 6 are mounted inside the frames formed by parts 21 and 22 on base plate 20, and plates 23 are equipped with grooves 3 to form the crease lines 8 in the work pieces 6. The height of parts 21 and 22 is so designed that after insertion of plates 23 there remains a sufficient height or step above plates 23 to blank the stock. This height or step should be about the same as the thickness of the stock, but could also be larger and for thin stock amount to several times the thickness of the stock.

Figure 11:
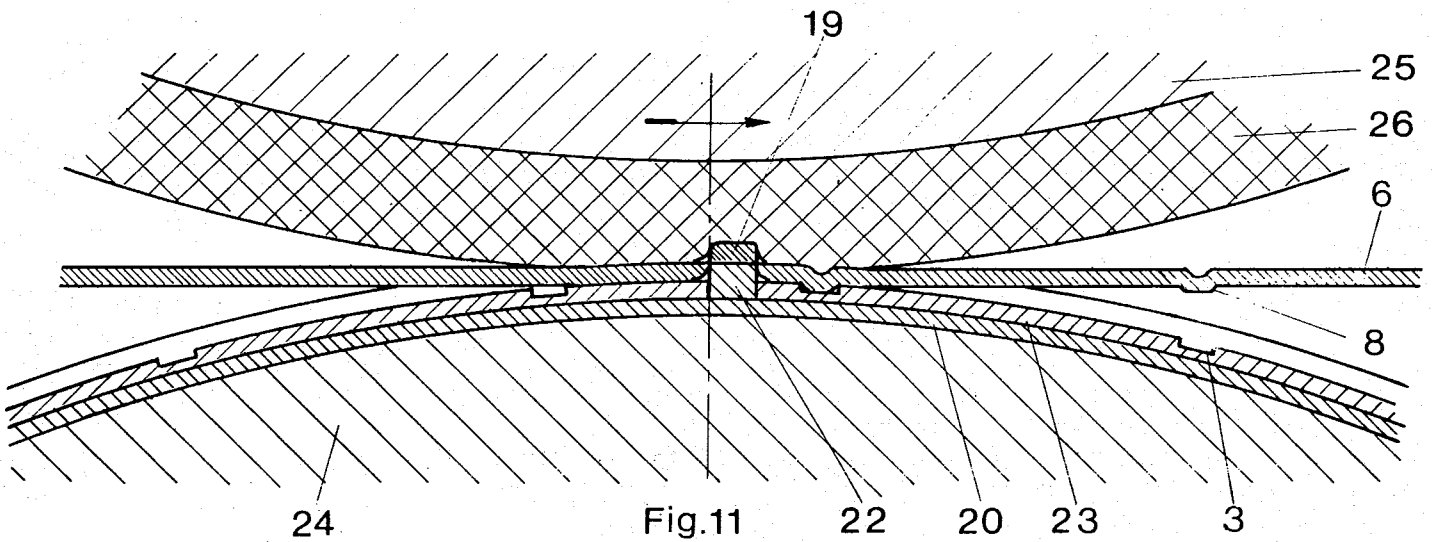

FIG. 11 shows a device according to FIG. 10 for rotational blanking. On a cylinder 24 the curved tool plate consisting of parts 20 to 23 is mounted, while a top cylinder 25 carries a soft, preferably elastic liner 26.

Figure 12:
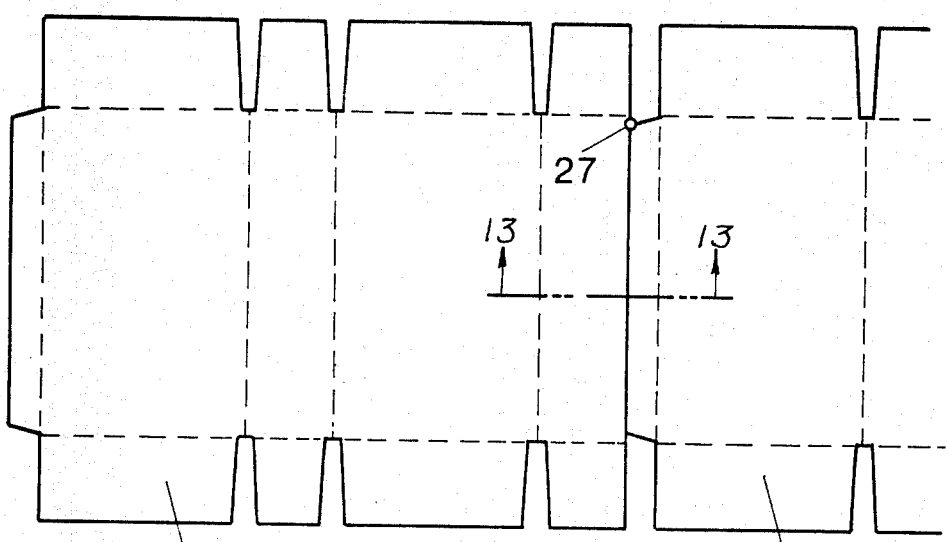
FIG. 12 is a top plan view of a continuous sheet for making work pieces of the form of FIG. 5.
Figure 13:
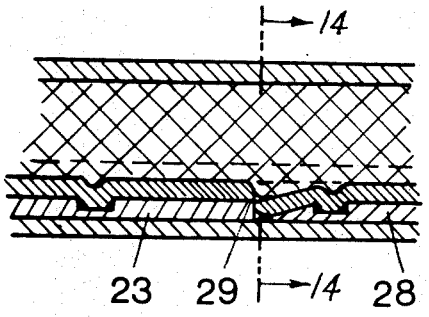
FIG. 13 is an enlarged, fragmentary view, in cross-section of the work pieces of FIG. 12 and the tool plate for forming the same, taken substantially along the plane of line 13—13 in FIG. 12.
Figure 14:
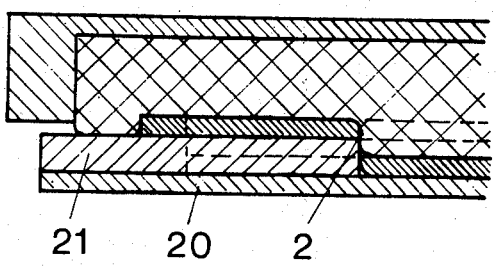
FIG. 14 is a fragmentary view, in cross-section, taken substantially along the plane of line 14—14 in FIG. 13.

FIG. 12 shows two work pieces 6 which are to be blanked without being separated by waste strips. At point 27, marked by a circle, three different stock parts touch, i.e., the two work pieces 6 and the marginal waste (not shown). It is impossible in this case to part the material with one height differential or step. At this point two height differentials or steps are needed, which provide three planes for the three different stock parts. As an example for the design of the tool plate in the area of point 27, a modification of the device in FIG. 10 is used, in which the bridges 22 are eliminated and plates 23, of which one is slanted, are in immediate contact with each other. FIG. 13 is a section through the modified device of the embodiment described in FIG. 12. FIG. 14 is another section, vertical to FIG. 13, while FIG. 15 shows a perspective view of the tool plate in the area around point 27.

Figure 15:
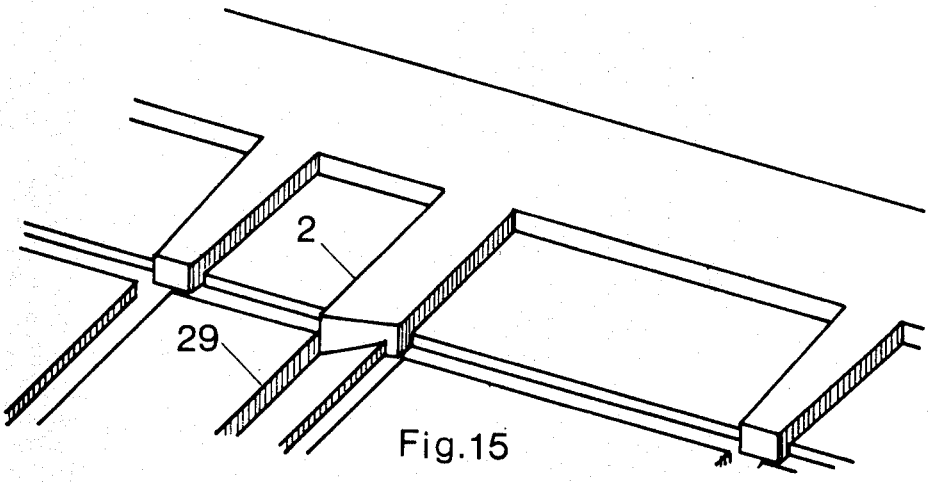
FIG. 15 is a fragmentary top prospective view of a tool plate suitable for forming the work pieces of FIG. 12.

Referring to FIGS. 13 through 15, on a base plate 20, there are again mounted the external frame parts 21 in addition to the plate 23 and a similar plate 28 slanted on the side turned towards plate 23. This provides, in a reversal of the stock-blanking principle shown in FIG. 4, the second step 29 which lies one step lower than the earlier described step 2. Another solution is possible in which the second step is higher than step 2.

Figure 16:
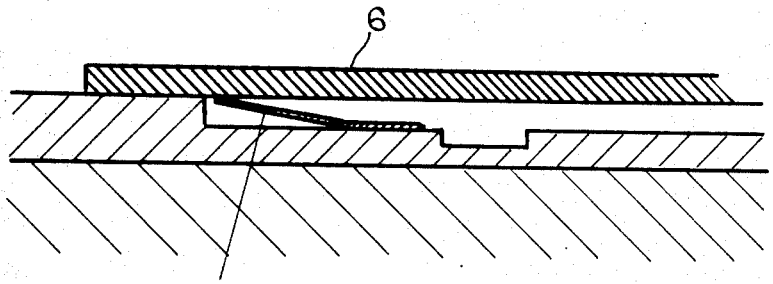
FIG. 16 is a fragmentary, side elevational view, in cross-section, of a tool plate having mechanical ejection means therein before blanking of the work piece.
Figure 17:
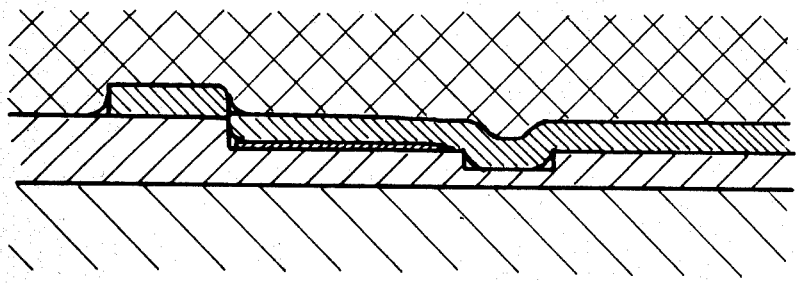
FIG. 17 is a fragmentary, side elevational view, in cross-section of the tool plate of FIG. 16 during blanking.

As an example suitable for an ejection element, we show in FIG. 16 an enlarged representation according to FIG. 1 of a leaf spring 30 mounted on the recessed area of the tool plate, which spring raises the work piece 6 after the blanking process shown in FIG. 17 into its original position in FIG. 16.

Figure 18:
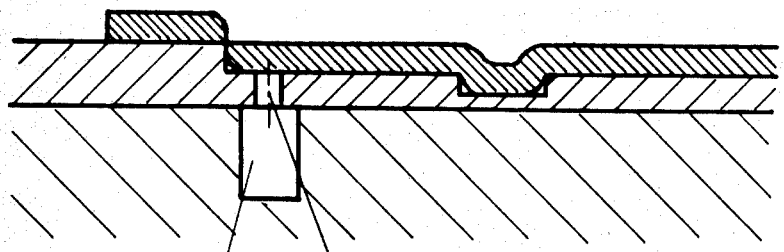
FIG. 18 is a fragmentary, side elevational view, in cross-section, of a tool plate having a pneumatic ejection means therein after blanking but before ejection.

For the same purpose, FIG. 18 shows the use of compressed air which is discharged from duct 31 through the perforations 32.

The operation of the above-described devices is the following: In the flat blanking devices according to FIGS. 8 to 10 and 13 to 15, blanking and creasing takes place due to the vertical movement of the lower table 15, the top table 16, or both tables, on which the tool plate and frame 14 with pressure pad 13 are removably mounted. If the die set is opened as shown in FIG. 16, the stock to be blanked is deposited on the tool plate. With the lifting movement of one or both tables 15 and 16 a uniformly distributed force is brought to bear via pressure pad 13 on the stock which is parted at steps 2, since the elastic surface of pressure pad 13 assumes the surface profile of the tool plate, pressing the stock between. In grooves 3 and at ribs 4 the stock is deformed by the force exerted by pressure pad 13 at the crease lines, and the lower height of the ribs 4, and the lower depth of grooves 3, as compared to steps 2, prevents the stock from being parted or severed at the ribs and grooves.

In the cylindrical devices for rotational blanking, of which FIG. 11 furnishes an example, the action of the force of the elastic liner 26 is limited to a narrow zone and progresses with the revolution of the cylinder along the length of the stock. Thereby the stock is blanked and creased, as well as conveyed continuously.

The structural forms described represent only a small part of the possible embodiments. Depending on the desired shape of the work pieces, there are multiple possibilities for forming the steps and combining them in one tool. These devices can be used for a wide variety of structural designs for blanking machines. In addition to the designs in which both surfaces are flat or cylindrical, it is also possible to provide devices in which one surface is flat and one or more are cylindrical and a rolling movement takes place between them. it is also possible to exchange the position of the two working surfaces, so that the elastic surface is acting from below.

What is claimed is:

1. A process for cutting a sheet of low tensile strength material such as paper or cardboard including the steps of, contacting a first side of said sheet with a cutting die formed with a cutting zone having a die step with a die surface extending away from one side of said die step at a first height and a die surface extending away from an opposite side of said die step at a height differential from the first named die surface, contacting an opposite side of said sheet with a resiliently displaceable elastic member positioned in juxtaposed relation to said cutting zone, and pressing said sheet by said elastic member against a higher of the die surfaces by relative displacement of said cutting zone and said elastic member toward each other, wherein the improvement of said process is comprised of the steps of:

pressing said sheet by said elastic member against a lower of said die surfaces by relative displacement of said cutting zone and said elastic member toward each other until said sheet assumes the profile of said die in said cutting zone and across said die step; and thereafter pressing said sheet by said elastic member against said die step by further relative displacement of said cutting zone and said elastic member toward each other while said sheet is supported between said elastic member and the surfaces of each side of said die step until pressure from said elastic member causes parting of said sheet precisely at said die step.

2. In blanking die apparatus for use in a machine for cutting a sheet of relatively low tensile strength material, such as paper or cardboard, by the combined action of two surfaces working on said sheet when disposed therebetween, said blanking die apparatus including a die member adapted for mounting to said machine and having a first surface formed with at least one rigid step therein, said rigid step being formed to provide a discontinuity and said die member up to both sides of said discontinuity being formed to evenly support said sheet, and a member adapted for mounting to said machine and having a second surface thereon provided by a resiliently displaceable elastic material, said resiliently displaceable elastic material having a thickness and a resiliency sufficient to urge said sheet down against said die member proximate said discontinuity, the improvement comprising:

said first surface having a profile proximate said rigid step and said rigid step further having a height dimension relative to the thickness of said sheet enabling said sheet to be pressed against said first surface until said sheet assumes the profile of said first surface across said rigid step prior to parting of said sheet, and said first surface having a profile and said rigid step having a height dimension sufficient to cause parting of said sheet precisely at said discontinuity when pressed further down against said rigid step by said resiliently displaceable elastic material.

3. Blanking die apparatus as defined in claim 2 wherein, said second surface is formed from a material having a low coefficient of friction.

* * * * *

UNITED STATES PATENT AND TRADEMARK OFFICE

CERTIFICATE OF CORRECTION

PATENT NO. : 4,050,362

DATED : September 27, 1977

INVENTOR(S) : Friedrich Schroter

It is certified that error appears in the above-identified patent and that said Letters Patent are hereby corrected as shown below:

Column 1, line 68, change "boty" to ---both---;

Column 2, line 64, after "of" insert ---the---;

Column 3, line 11, change "not" to ---no---;

Column 4, line 46, change "device" to ---devices---.

Signed and Sealed this

*Second* Day of *January 1979*

[SEAL]

*Attest:*

RUTH C. MASON
*Attesting Officer*

DONALD W. BANNER
*Commissioner of Patents and Trademarks*